US005575294A

United States Patent [19]

Perry et al.

[11] Patent Number: 5,575,294

[45] Date of Patent: Nov. 19, 1996

[54] METHOD AND DEVICE FOR MANAGING FREEZING GAIT DISORDERS

[76] Inventors: Robert E. Perry, 32 Abbott St., South Weymouth, Mass. 02190; Linda Perry, 38 Hemlock Rd., West Roxbury, Mass. 02132

[21] Appl. No.: 215,942

[22] Filed: Mar. 21, 1994

[51] Int. Cl.[6] ..... A45B 3/00

[52] U.S. Cl. ..... 128/774; 128/782; 362/102

[58] Field of Search ..... 362/102, 103; 128/774, 782; 2/295; 135/65; 36/136

[56] References Cited

U.S. PATENT DOCUMENTS

| | | | |
|---|---|---|---|
| 1,184,396 | 5/1916 | Trimble | 362/103 X |
| 2,271,190 | 1/1942 | Giamo | 362/102 |
| 2,572,760 | 10/1951 | Rikelman | 362/103 |
| 3,008,038 | 11/1961 | Dickens et al. | 362/103 |
| 3,067,322 | 12/1962 | Sala | 362/103 |
| 3,336,469 | 8/1967 | Barnes, Sr. et al. | 362/102 |
| 3,570,473 | 3/1971 | Konvalin . | |
| 4,062,371 | 12/1977 | Bolen | 362/102 X |
| 4,562,850 | 1/1986 | Earley et al. | 362/102 X |
| 4,625,742 | 12/1986 | Phillips | 362/102 X |
| 4,837,666 | 6/1989 | Conkle | 362/102 |

OTHER PUBLICATIONS

Atchison et al., (1993), "The Syndrome of Gait Ignition Failure: A Report of Six Cases", *Movement Disorders*, vol. 8, No. 3, pp. 285–292.

Achiron et al., (1993), "Primary Progressive Freezing Gait", *Movement Disorders*, vol. 8, No. 3, pp. 293–297.

Jankovic, M.D., (1982), "Management of Motor Side Effects of Chronic Levodopa Therapy", *Clinical Neuropharmacology*, vol. 5, Suppl. 1, S19–S28.

*Primary Examiner*—Sam Rimell

[57] ABSTRACT

A method and device for managing akinetic episodes of "freezing" and "start hesitation" experienced by individuals who suffer from Parkinson's disease and related disorders of the extrapyramidal nervous system projects a beam of light to facilitate mobility. The projection device, used alone or adapted to an assistive support such as a cane or walker, or to an item of clothing, projects a thin beam or discrete pattern of light using a laser, flash or other high-intensity light source to provide a luminous mark in the path of a standing individual. The mark is flashed at will by push-button control, and provides a visual cue to the operator encouraging him or her to step up and over the projected image. This cue breaks the freeze and permits the user to resume motion. Preferably a timer extinguishes the light after a brief interval. Circuitry may blink the light during the projection interval to enhance its efficacy. Operation of this device requires no significant physical or mental effort, and is to be implemented as a mechanical treatment under existing health and disability programs.

20 Claims, 5 Drawing Sheets

METHOD AND DEVICE FOR MANAGING FREEZING GAIT DISORDERS

BACKGROUND OF THE INVENTION

Parkinson's disease is a chronic, progressive, neurologic disorder resulting from the selective degeneration of specific brain cells of the substantia nigra. These cells produce dopamine, a neurotransmitter which is necessary to communicate the neurochemical messages required for normal body movement and coordination.

The incidence of Parkinson's disease is reported as 1% of the population over the age of 50, and as high as 10% over the age of 65, with some occurrence in younger individuals but negligible incidence in children. Over half a million people in the United States are afflicted with this condition.

Clinical presentation of the disease includes tremors, muscular stiffness, slowness of movement and balance impairment. Walking difficulties may include shuffling, festination and akinetic episodes which are popularly referred to as "freezing." The course of Parkinson's disease and related extrapyramid disorders is variable but is usually characterized by a slow progression. The clinical manifestations of Parkinson's disease are divided into five stages from mild to severe, each stage reflecting the individual's capacity for functional ability. The hallmark of progression is when balance begins to deteriorate and the individual experiences complications of medical treatment.

Currently, medical treatment of Parkinson's disease is aimed at replacing the lost dopamine with a drug called Sinemet. The drug temporarily alleviates some of the symptoms for a few hours but does not cure the condition. While scientists continue to search for more effective medication and ultimately for a cure, the focus of everyday management is to prevent complications and assist individuals to manage the disease at home with emphasis on supporting their functional ability and in particular, their mobility. The ability to get around from place to place directly affects their quality of living.

The word akinesia means partial or complete loss of movement, and in the discussion of Parkinsonism usually denotes the sudden inability to initiate movement. Arms and hands may become momentarily akinetic, but much more commonly the feet/legs become akinetic. These "freezing" episodes present a distressing problem for the individual who is attempting to walk, by impairing their ability to get from place to place. The exact mechanism of pathology is not known; however, from a clinical standpoint, freezing episodes can correlate with low levodopa plasma levels or the Parkinsonian state. Freezing may also occur as a result of dopa-excess, as a side effect from the drug Sinemet, but this is rare.

The neurologist Joseph Jankovic M.D., in Clinical Neuropharmacology, Vol. 5, Suppl. 1, pg. S21, 1982, described freezing episodes thus:

> "Some patients in more advanced stages of the disease develop sudden 'freezing' episodes. One example of this is 'start hesitation', during which time the patient is unable to initiate gait or other movements. The freezing episodes may also be manifested by sudden interruption of mobility, particularly when walking through narrow passages or getting out of an elevator. Such freezing, termed akinesia paradoxica, may last from seconds to minutes and, occasionally, hours. It may be relieved by asking the patient to count 'one, two, one, two, one, two,' by playing marching music, or by introducing sudden, unexpected, and even shocking situations, such as a tossed ball or the sudden loud noise of an approaching motor vehicle. This unexpected sudden mobility contrasts dramatically with the akinetic episodes described above and is termed kinesia paradoxica."

Usually, freezing is associated with the advanced stages of Parkinson's disease (stage 3,4,5) but it can also be present earlier in the disease course when balance is still intact. Individuals have described their feet as suddenly being "stuck", "glued" or "cemented" to the floor for brief (seconds) or longer (minutes) periods of time. This happens spontaneously while they are walking or as they begin walking (start-hesitation) with little warning. Some people are prone to freezing when they approach a narrow space, threshold or doorway. Freezing may occur once or several times in succession during a short walk, and the incidence of episodes may vary from day to day. Freezing and/or start-hesitation impedes free mobility and, as the disease progresses, increases the risk of falling.

People have attempted to manage these akinetic episodes in various ways. The scientific basis for the management techniques and why they work would be difficult to explain (even for a specializing neurologist), but they usually involve playing a "trick" on the brain; e.g., providing some visual cue which encourages the feet to step up and over, as if unsticking from glue, rather than stepping forward, as with regular walking. These tricks are usually taught in the physician's office by the doctors, nurses and therapists who are familiar with the symptom. People also learn the methods from reading books about Parkinson's disease or by attending support group meetings. One technique that some use is to march or rock to sound cues such as marching music or counting. Another method is to draw an imaginary line in front of the afflicted person's feet and encourage him or her to "step up and over the imaginary line." Also used is the dropping or placing of objects on the floor in front of the person's feet; forcing them to step over the object (paper, tissue, straws, belts, etc.). Virtually any object can be used to "step up and over."

The aforementioned interventions have been helpful to people, but each has drawbacks. Dropping or placing items of the floor requires not only that you have the objects ready to use but that someone be available to place and retrieve the objects. One alternative to this is to use small disposable objects (e.g., cards) and leave the object(s) behind. With other objects, if the object is 3-dimensional, such as a belt, the individual could trip and fall. The imaginary line method works well, but again, someone usually must accompany the individual to draw the line with their foot or hand. Some patients find it difficult to imagine a line during the freezing episode and remain unable to move until involuntary release occurs. Sound cues (such as marching music) are not often feasible, particularly outside the home, and many find singing or counting aloud embarrassing. Often, a Parkinsonian patient will just sit down and stop what he or she is doing. At the present time, these homemade tricks are the only mechanical techniques available to individuals in the United States who suffer from freezing and start-hesitation. For many people, the above-listed techniques are too impractical to consider using consistently.

SUMMARY OF THE INVENTION

In accordance with the present invention a freezing gait disorder is managed by projecting a mark on the ground upon the occurrence of freezing or hesitancy, to enable a person to resume motion. The mark takes the form of a luminous pattern or bright light aimed near the person's feet, and preferably the mark has an extent, e.g., is a bar or line, or even an imagewise pattern, such as the image of a board, block or small object.

A device for carrying out the invention is a hand-held or hand-actuated light source, having a projection head facing generally centrally downward, with a push button for turning on the light. The projection head preferably projects a beam with the cross-sectional shape, perpendicular to its projection axis, of a bright thin line, preferably having a small width, for example, of about several centimeters and a length between about five centimeters and one hundred or more centimeters. Alternatively, it may project a shape, which may be geometric, such as a square, triangle or circle, or may be the image of an object, such as a mouse, a hammer or spoon. Preferably, the light projects a collimated image beam, so that the mark projected on the ground is of a substantially fixed size and intensity independent of the distance to the floor; the beam may also be colored, so that its image is perceived as a visually distinct or foreign object, or obstacle, in the person's path. Adjustments may be included in the device for setting a focus, for changing the pattern or size of the beam, or for scanning, blinking or switching the beam. The device may also include a timer that automatically extinguishes the projection light after several seconds.

In one embodiment, the mark projector is incorporated in a cane or other support. In other embodiments, it is incorporated in a separate hand-lamp, is mounted to a cane, walker, shoes or a waist belt. In the latter cases, the device may include an adjustable mounting bracket which allows the device to be aimed so that the mark is projected at a fixed position in relation to the cane, the walker or the subject's feet. This fixed position is selected to be generally just ahead of the position normally occupied by a person's feet, but may be adjusted to suit the individual.

Practical embodiments of the device may be made with one or more molded cylindrical lenses to provide a collimated rectangular beam, and may utilize a strip laser diode mounted next to a light source or a line of LED's to provide a luminous stripe or dot pattern for projection by the lens assembly. Alternatively, it may employ a high intensity conventional light illuminating a slit, or a fiber, rod or bar edgewise to provide the beam, or a pattern for projection in the beam.

BRIEF DESCRIPTION OF THE DRAWINGS

These and other features will be understood from the following description of illustrative embodiments, wherein.

DETAILED DESCRIPTION OF THE INVENTION

Figure 1:
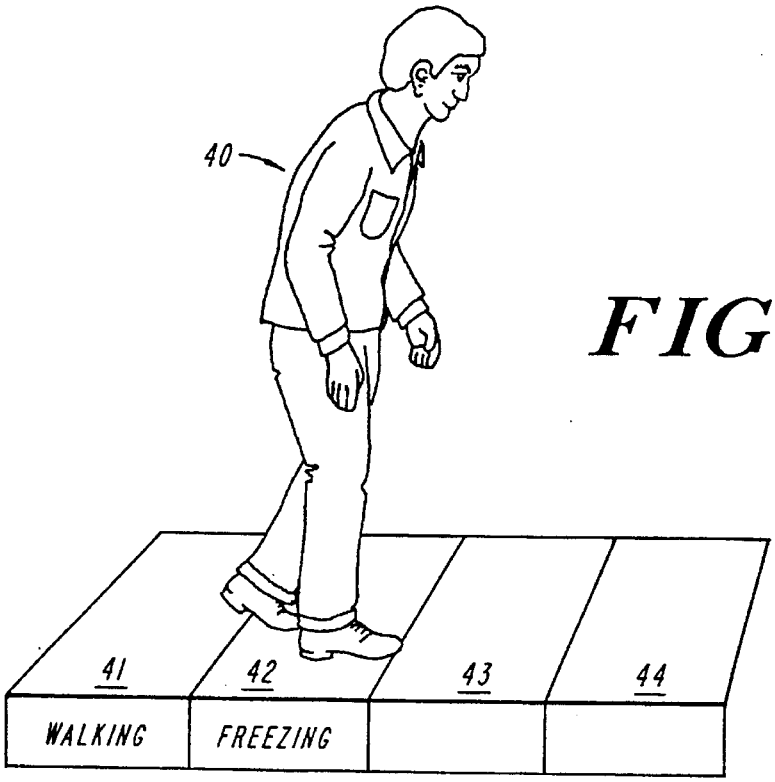
FIG. 1 illustrates the problem addressed by the present invention.

FIG. 1 illustrates the basic problem addressed by the present invention. A person 40 with a freezing gait disorder, e.g., a person subject to akinetic episodes due to Parkinson's disease, is walking along a path 41, 42, 43, 44, and unpredictably undergoes a freezing episode.

Figure 2:
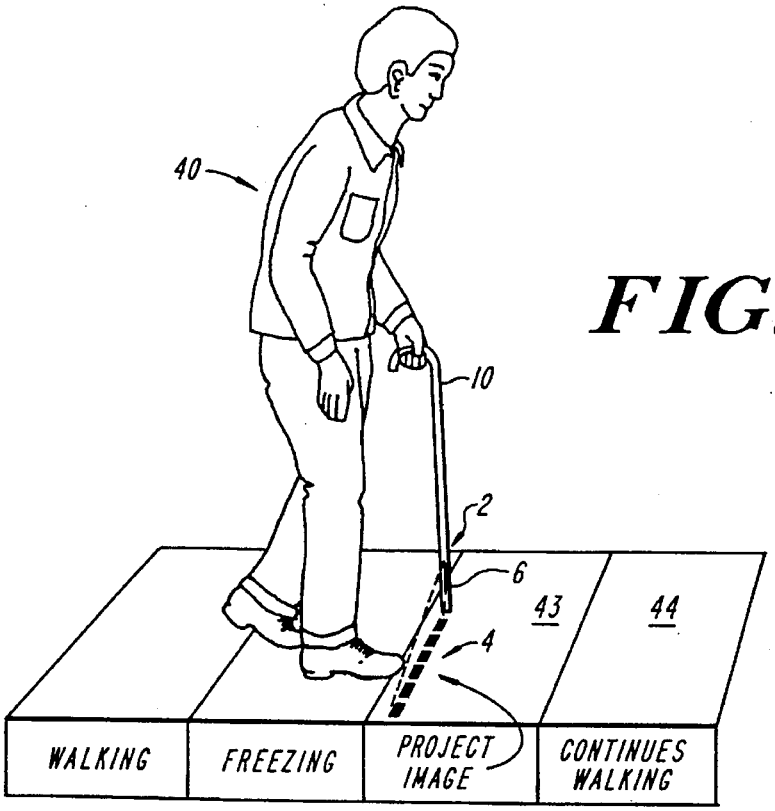
FIG. 2 illustrates a method of the present invention, and use of a hand-held device in accordance with one embodiment of the invention.

FIG. 2 shows the method of the present invention, wherein the person then activates a projector 2, to project a bright light mark 4 at his feet. He is then able to consciously move past the mark. The hand-held embodiment of such a projection device 2 is shown at a cane 10 used by the person walking along a path P. Projector 2 may employ elements of a simple flashlight, and the illustrated mark 4 extends in a rectangular strip, having a length much greater than its width. This particular pattern corresponds to the "imaginary line" mark which has empirically been found, where drawn on the ground, to have broad applicability in allowing or prompting people to overcome akinesia, and it also makes it relatively easy to point or aim the device, since accuracy of the left-to-right alignment is relatively unimportant for this shape mark. The cane 10 illustrated in FIG. 2 may include rechargeable batteries, and its body or handle may have a charging connector for replenishing charge. Charging and voltage conversion circuitry may be entirely internal, with a flip-out plug such as is commonly used on rechargeable flashlights and the like, or the device may contain only the rechargeable cells, in which case the connector is preferably a plug or socket that connects to an external charging circuit or module.

The projector 2 differs, in general, from a common flashlight or laser pointer primarily in its geometry and optics, having a light output head 6 generally being enlarged in one direction to accommodate the necessary luminous and/or optical elements for projecting a widened image beam, although, as noted below, smaller symmetric heads are also possible. In general, it is not required that the beam have high power or cover a large area as it does with a flashlight. However, high intensity is desirable, since the device is to be used in light conditions that may include daylight. Nonetheless, the beam is required to cover only a modest area, about several inches square, at an area of the ground, which may extend several feet away from the projection head 6, and therefore the beam requires comparatively little power. As described below with regard to FIG. 6, the head optics produce a collimated or at most mildly divergent beam, so that the projected mark does not become weak, blurred or diffuse when the projection distance changes.

Figure 3A:
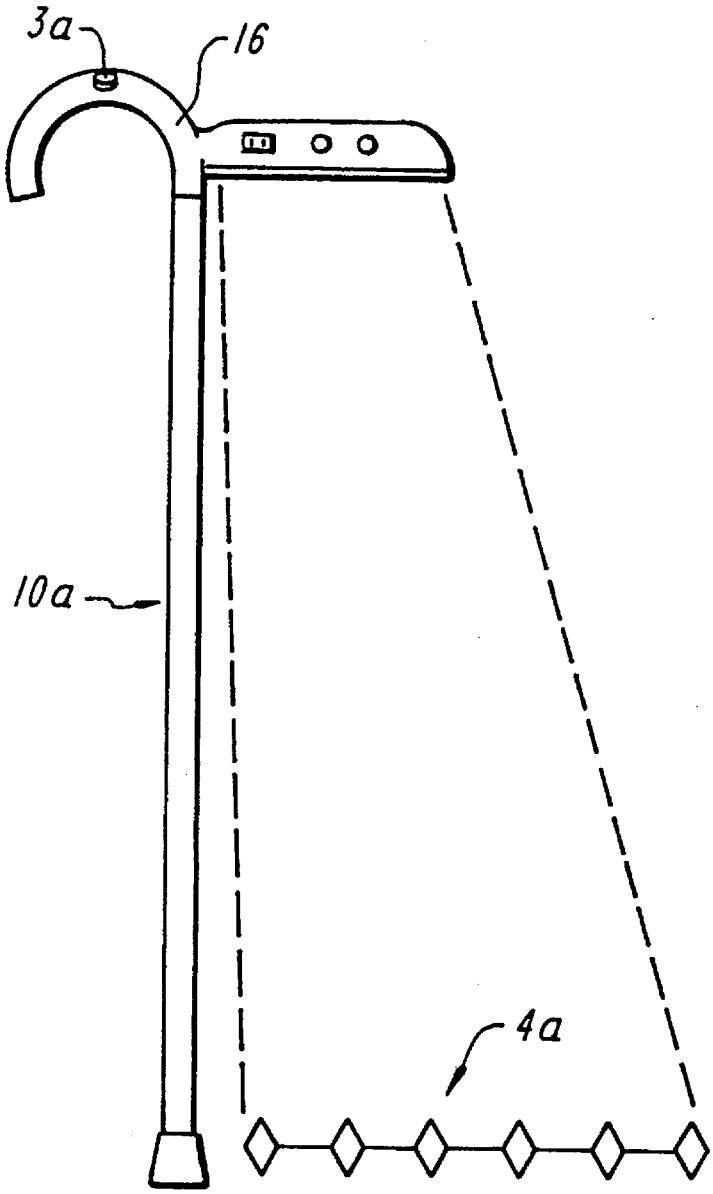
FIG. 3A illustrates a unitary cane embodiment.
Figure 3B:
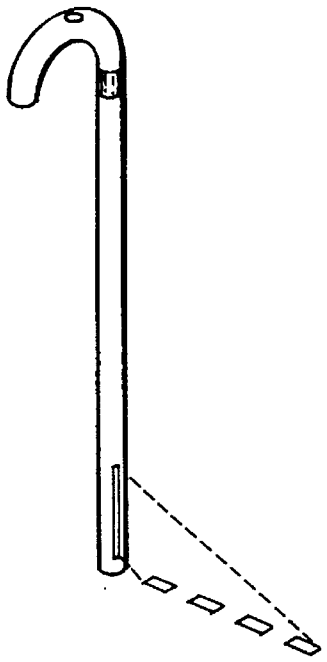
FIG. 3B illustrates a cane embodiment with a side window.
Figure 3:
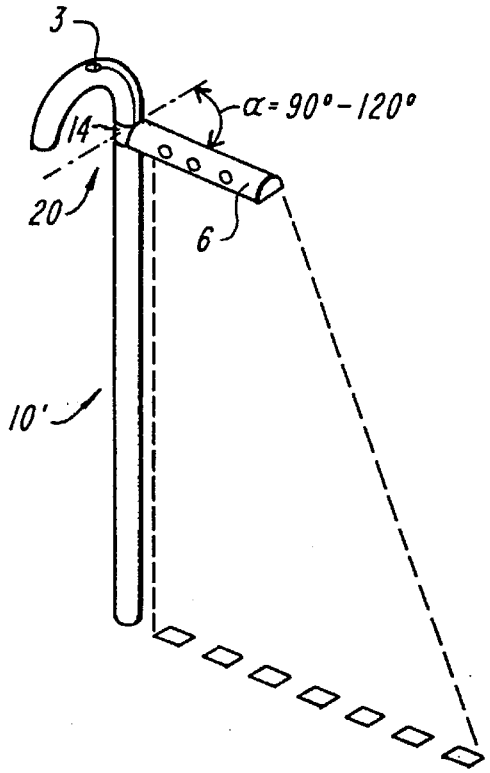
FIG. 3 illustrates the embodiment of FIG. 2 separately mounted on a cane.

In a further embodiment of this aspect of the invention, the projector 2 may be replaced by a separate assembly 20 which is adapted to mount on a support device such as a cane 10' (FIG. 3). A mounting bracket 14 secures the projector, and preferably provides a range of adjustment, so that the head 6 may be directed at a desired location. In general, this location would lie centrally behind or just in front of the tip of a cane and to one side. Accordingly, bracket 14 is configured to rotate or otherwise allow adjustment of the mounting orientation to direct the beam at such a location in relation to the position of the user's feet.

This is preferably achieved by mounting the projector 2 so that, as viewed from above, it makes an angle $\alpha$ of approximately 90–120 degrees with the handle of the cane, so that it projects to the side when the handle points directly backwards in use. The head 6 is mounted on the left or right, depending on whether the user is to hold the cane 10 in the right or left hand, respectively, so that mark 4 is projected centrally inward to a position directly in front of the user. An activator button 3 may be provided on a short wire to be mounted on the curved handle of cane 10 in a position conveniently accessible to the user's thumb.

FIG. 3A shows a related embodiment wherein a cane 10*a* has a unitary handle/projector unit 16, which may, for example, be a molded unit in which the handle and projection housing are performed in the correct right- or left- hand angular alignment, and the switch, battery, optical and illuminating elements are housed within the unit 16. This figure illustrates a pattern or mark 4*a* formed of a plurality of discrete, high intensity, luminous dots, diamonds or rectangles. Such alternative patterns may be preferable in terms of optimizing the available light power, and may be fabricated with economy and relative simplicity of building or aligning the device using discrete light sources or optics, as discussed below. However, the invention also contemplates that a great variety of other luminous patterns or images will be effective, the primary requirement being that the projection head form a clearly perceivable image directly in the user's path. In particular, a variety of geometric shapes, silhouettes of animate or inanimate objects, or even moving wave patterns (formed for example by aiming a small bright beam at a vibrating reflector or a moving diffractor) are expected to be useful projection marks. The projector may include mechanisms for various forms of adjustment, in terms of the front-to-back projection angle, focal distance, and side-projection angle. In addition to being adapted to a straight cane as shown in FIGS. 3–3B, it could be fitted on an offset ortho cane, or a quad cane having plural feet as used by persons with more advanced disease symptoms. Other mounting positions are possible, such as on a belt, shoe or surgical support.

Figure 4:
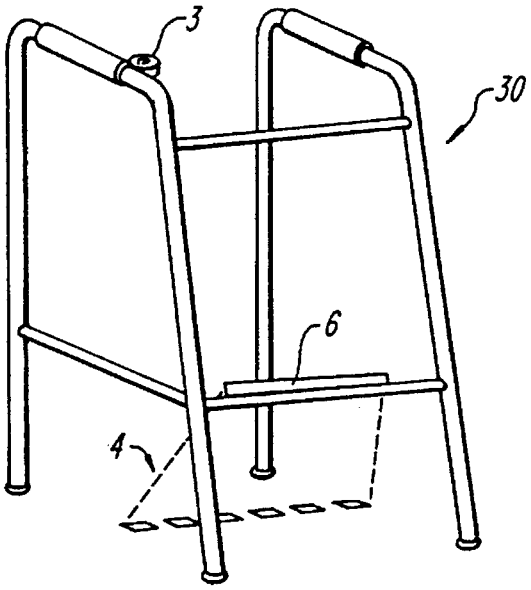
FIG. 4 illustrates an embodiment of the invention on a walker.

The device of FIG. 3 may also be mounted on a walker 30 as shown in FIG. 4. In this case, mark 4 is projected centrally just ahead of or behind the front feet of the walker. As with the cane, a simple bracket and clamp arrangement may secure and aim the device, while a separate switch button 3 is positioned for ease of activation. Numerous mounting positions are possible on the body of the walker, and different forms of articulation or brackets may provide flexibility in aiming the device. Depending on the form of illumination employed, it may be preferable to mount the device as shown on a front cross member, at a position low to the ground, to maximize the intensity of the projected image, or higher up on a side bracket or cross-piece. In embodiments wherein the projector is built in a leg or in a cross bar 22, it may have internal wiring to a button 3 located at a more easily reached position for activating the projector. Whether the projection is integral or added on, the frame of the walker provides a fixed reference that allows it to be precisely and permanently aimed and focused on the ground in the correct position. In a walker with roller wheels, the activator button is preferably mounted adjacent to one of the hand brake control levers.

Figure 5:
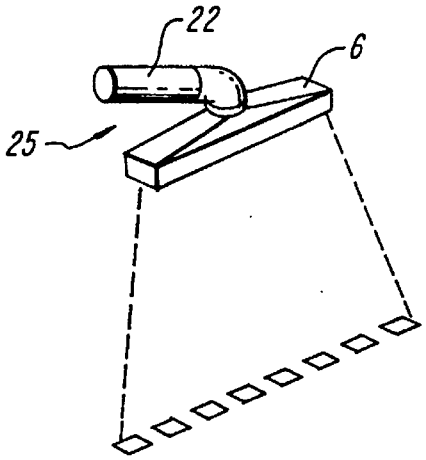
FIG. 5 illustrates another embodiment as a hand-held unit.
Figure 6:
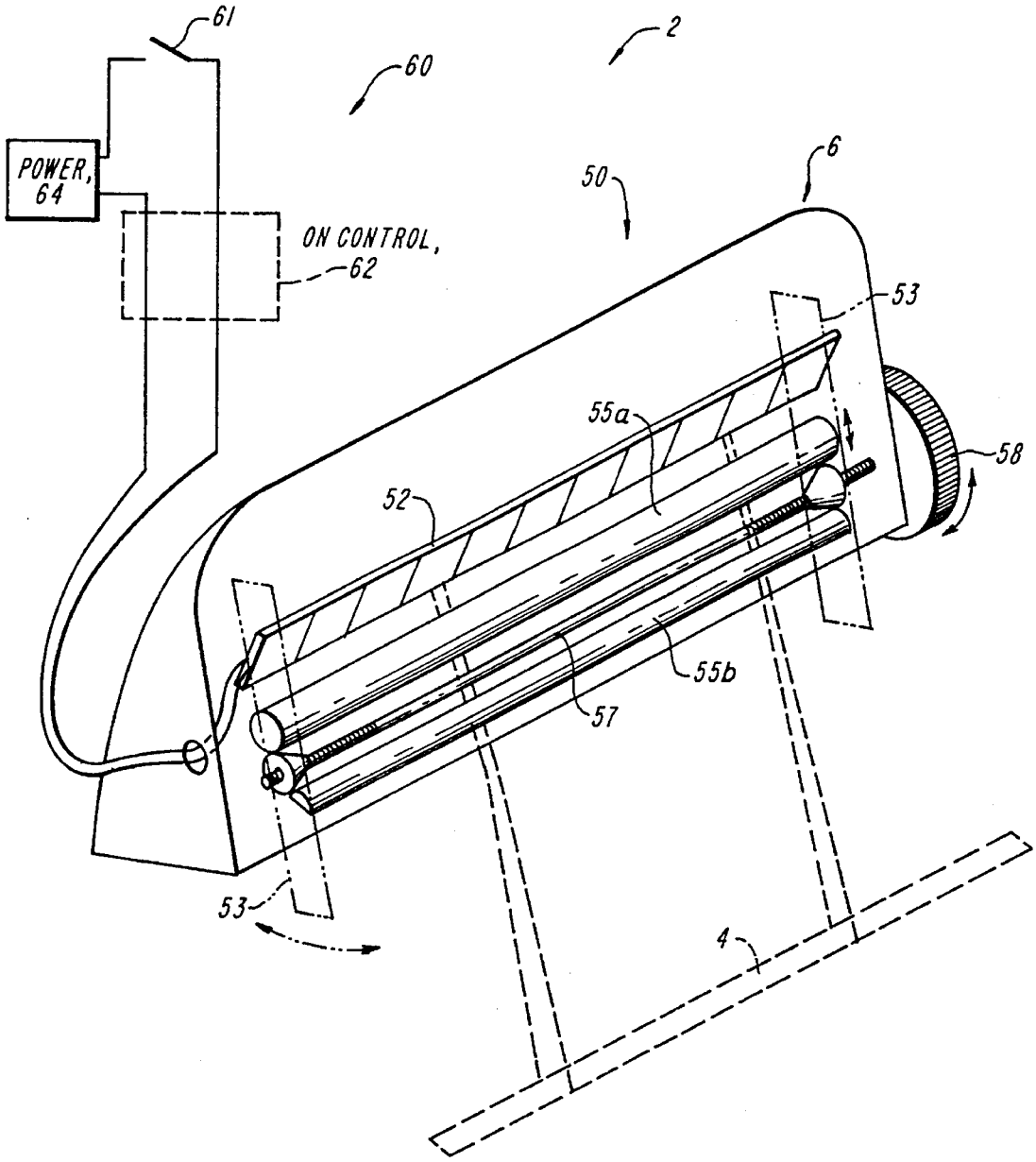
FIG. 6 illustrates optical elements suitable for use in embodiments of the invention.

In any of the foregoing embodiments, the projection device admits of different constructions, the optical elements of which will be readily determined by a person skilled in the art, and a great many substitutions of alternative elements or subsystems are feasible. One class of constructions is schematically shown in FIG. 6 using the general shape of projector head 6 of the clamp-on device of FIG. 3 or the hand-held device 25 of FIG. 5. The projection device has two principal portions, an electronic portion 60 comprised of switch 61 and power unit 64 with optionally a LIGHT ON control circuit 62, and an optical portion 50. Optical portion 50 comprises a light or luminous pattern generator 52 which is driven by the power unit 64, and projection optics 54 which focuses, aims or scans the light or pattern at the correct location on the ground. Each of these portions, and their elements, may take many forms.

As discussed above, elements 61 and 64 are preferably a push button switch, and a set of rechargeable batteries, respectively. The LIGHT ON control 62, if present, may advantageously take several forms. In general, it is desirable that the LIGHT ON control include a timer configured so that, once button 61 is pressed, the unit stays lit for a fixed short time interval, for example, two, five or ten seconds. Applicant also contemplates a LIGHT 0N control that blinks the power on and off during the actuation period. This may be useful either for charging a high power storage device to fire a strobe light (e.g., xenon flash source) to obtain higher intensity, in which case the unit serves to adapt the necessarily low voltage power source 64 to a high intensity light source, or the control 62 may blink simply to make the projected light pattern 4 more visually noticeable to enhance its effectiveness for overcoming a freezing incident. Applicant expects a strobed luminous mark to be more effective than a continuous mark since the analogous auditory stimulus—a sharp noise—has been found effective to interrupt freezing episodes.

In the light projection portion 50, the light source 52 is illustrated as a strip, which may for example be a laser diode element composed of many cells on a single sheet laid out in a row, or may be formed by applying a conventional high intensity source such as a xenon flash or a krypton bulb to a strip-like light transmissive or light conducting element or a window defining element, such as a pattern slit or a strip or fiber of frosted glass or the like. A vibrating mirror may also be used to transform a small, light source into a scanned strip of light or line of dots. The source 52 is projected by projection optics 54.

The projection optics 54 are shown as held by frame elements 53 in alignment with the light source 52, and as including optical elements for collimating, focusing or aiming a beam from the light source 52. The FIGURE illustrates a pair of cylindrical or half-cylindrical lenses 55*a*, 55*b* arranged parallel to the strip light 52 which are mounted so that their spacing from source 52 and from each other may be adjusted while keeping the lenses parallel. This is accomplished in the illustrated embodiment by a pair of positioning wedges 56 mounted on a common shaft 57, which are axially moved by turning knob 58. Other lens positioning means, such as cams, telescoping sleeves or the like may be substituted. In addition, rather than lenses, holographic or Fresnel elements, or reflector elements or arrays of focusing elements may be used. Elements such as rod lenses may be used. In that case, each rod lens may be aligned end-on, directed at its own point-type light source such as a bulb or separate LED so that the device 2 produces a number of pencil-like beams that together form the projected mark, much as illustrated in FIG. 3A. Alternatively, as discussed above, collimation may be inherent in the light source (such as in a laser) and the optics may include simple elements, such as a single scanning mirror, or a pattern-defining window and/or a beam expander. Operation is straightforward, and the user is simply instructed to respond to a freezing incident by actuating the light source to project a luminous mark in his path of travel.

Figure 7:
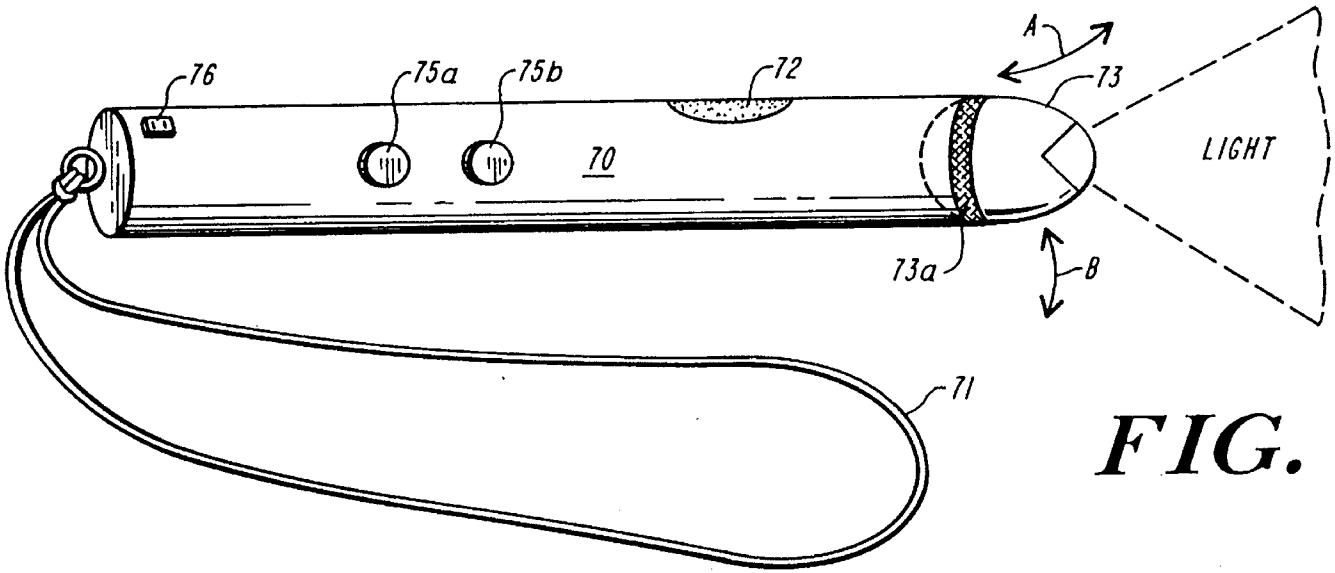
FIG. 7 illustrates a flashlight embodiment of the invention.

For individuals who still possess excellent motor control and do not use a cane or walker, a simpler embodiment 70 of the invention may be adequate. As shown in FIG. 7, such embodiment 70 has the form of a small flashlight that projects a beam or focused image directly from a symmetrical tip. A short cord 71 allows the device to dangle from the user's wrist without effort until needed, and an actuation button 72 which may be sealed under a rubber diaphragm is located for handy actuation. In this embodiment, the tip 73 may be formed as a ball and socket assembly, secured gently against the housing by a cap ring 73*a*, so that it may be rotated through horizontal and vertical swings A, B to direct the light at a desired angle from its normal hand-held orientation. Adjusting knobs 75*a*, 75*b* may be provided with suitable internal mechanisms to adjust the shape or focal distance (if non-collimated) of the beam. For example, the knobs may couple to rods that bend a reflector, bend or squeeze a flexible lens element, or shift the spacing between the light and one or more optical elements, such as a specular reflector. In a preferred embodiment, the light source is a cheap, relatively divergent laser source, such as a YAG or helium-neon laser, capable of high intensity, or is an even cheaper Krypton bulb source. The optical element(s) of the system may consist entirely of a simple cast or molded shaped glass or plastic article having a shape that internally reflects light and serves as a beam-shaping waveguide body that spreads the round beam into a strip-like curtain and projects it as a collimated rectangular beam, so that no further optical elements are required for focus or shape adjustment. However other optics, different patterns or pattern-defining elements, and other light sources may be used in this embodiment as well.

Figure 8:
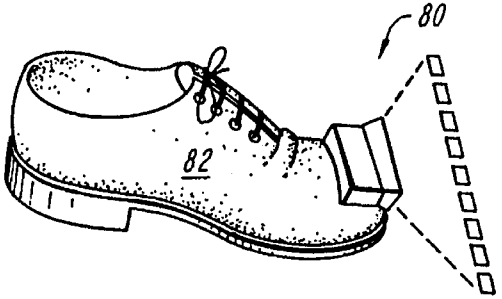
FIG. 8 illustrates a footwear embodiment of the invention.

FIG. 8 shows another embodiment 80 wherein a mark projector is mounted on a shoe 82. In this case, the projector is configured to project a luminous mark or pattern directly in front of the foot. A separate control switch on a short lead of wire extending to the user's belt or pocket may be provided for hand actuation, or the device may have an ON switch actuated by a foot movement or wiggling one's toes. Yet other forms of projector may be configured to mount on a belt or other item of clothing, or on some other support.

The foregoing description is intended as illustrative and not limiting, and it is understood that the invention is embodied in many and varying constructions. These illustrative embodiments having been thus described, variations and modifications will occur to those skilled in the art, and such variations and modifications are considered to fall within the scope of the invention, as set forth in the claims appended hereto.

What is claimed is:

1. A method of managing a freezing gait disorder, comprising the step of providing a device actuable for projecting a luminous mark, and instructing a user to respond to an instance of freezing by projecting a luminous mark in a path of travel to create an apparent obstacle and enable movement.

2. The method of claim 1, wherein the mark is a strip oriented across the path of travel.

3. The method of claim 1, wherein the mark is an image of an object.

4. The method of claim 1, wherein said projecting is effected by turning on a projector attached to a walking aid.

5. The method of claim 1, wherein said projecting is effected by manually turning on a projector.

6. The method of claim 1, wherein said projecting includes projecting for a plurality of distinct short time intervals.

7. The method of claim 1, wherein said projecting a luminous mark includes projecting an array of marks constituting a pattern.

8. A device for managing a freezing gait disorder, such device comprising a self-powered projection unit including a light source and a projection head having optical elements for projecting a substantially collimated beam of light from the source to form a sharply defined luminous image on the ground ahead of the unit, said light having a brightness such that the luminous image appears as an obstacle and means for attaching said projection unit to an orthopedic support device.

9. A device according to claim 8, wherein the image is projected in an elongated stripe region.

10. A device according to claim 8, wherein the image is an image of an object.

11. A device according to claim 10, wherein the object is a geometric shape.

12. A device according to claim 8, wherein the image covers a beam spread substantially under $\pi/6$ in one direction.

13. A device according to claim 8, which is bearable by a user as he walks on the ground, and wherein the optical elements project a substantially collimated beam such that the beam forms an image of substantially uniform size independently of height of the device above ground.

14. A device according to claim 8, further comprising means for mounting the device to a walking aid to project said beam downward from said walking aid.

15. A device according to claim 8 wherein said device is built into an article selected from the set comprising a cane and a walker.

16. A device according to claim 8, wherein said device is built into an article of clothing.

17. A device according to claim 8, wherein the optical elements are adjustable for varying at least one of shape or focal distance of a beam forming said image.

18. A device according to claim 8, further comprising a timer for determining a short ON TIME interval when actuated and thereafter automatically turning off the light source.

19. A device according to claim 18, wherein the ON TIME interval comprises a plurality of short successive blinks.

20. A device according to claim 8, wherein the light source is selected from among a krypton bulb, a laser and a flash source.

* * * * *